US009657375B2

(12) United States Patent
Lorentzen et al.

(10) Patent No.: US 9,657,375 B2
(45) Date of Patent: May 23, 2017

(54) USED BEVERAGE CONTAINER ALUMINUM COMPOSITION AND METHOD

(71) Applicant: Golden Aluminum, Inc., Fort Lupton, CO (US)

(72) Inventors: Leland Lorentzen, Erie, CO (US); Mark Selepack, Longmont, CO (US)

(73) Assignee: Golden Aluminum, Inc., Fort Lupton, CO (US)

( * ) Notice: Subject to any disclaimer, the term of this patent is extended or adjusted under 35 U.S.C. 154(b) by 643 days.

(21) Appl. No.: 13/931,403

(22) Filed: Jun. 28, 2013

(65) Prior Publication Data

US 2014/0363332 A1 Dec. 11, 2014

Related U.S. Application Data

(60) Provisional application No. 61/833,276, filed on Jun. 10, 2013, provisional application No. 61/835,997, filed on Jun. 17, 2013.

(51) Int. Cl.

| | |
|---|---|
| ***C22C 21/08*** | (2006.01) |
| ***C22C 21/06*** | (2006.01) |
| ***A47G 19/22*** | (2006.01) |
| ***C22B 21/00*** | (2006.01) |
| ***C22C 21/00*** | (2006.01) |
| *C22F 1/04* | (2006.01) |

(52) U.S. Cl.

CPC ..... *C22C 21/08* (2013.01); *A47G 19/2205* (2013.01); *C22B 21/0069* (2013.01); *C22C 21/00* (2013.01); *C22C 21/06* (2013.01); *C22F 1/04* (2013.01)

(58) Field of Classification Search

CPC ..... C22C 21/08

See application file for complete search history.

(56) References Cited

U.S. PATENT DOCUMENTS

| | | | |
|---|---|---|---|
| 3,787,248 | A | 1/1974 | Setzer et al. |
| 3,960,073 | A | 6/1976 | Rush |
| 4,113,895 | A | 9/1978 | Watt et al. |
| 4,138,941 | A | 2/1979 | McMillin et al. |
| 4,260,419 | A | 4/1981 | Robertson |
| 4,282,044 | A | 8/1981 | Robertson et al. |
| 4,318,755 | A | 3/1982 | Jeffrey et al. |
| 4,956,906 | A | 9/1990 | Masse et al. |
| 4,984,517 | A | 1/1991 | Doublet |
| 5,339,731 | A | 8/1994 | Howard et al. |
| 6,006,415 | A | 12/1999 | Schaefer et al. |
| 6,105,806 | A | 8/2000 | Stasiuk |
| 6,290,785 | B1 | 9/2001 | Selepack et al. |
| 6,306,468 | B1 | 10/2001 | Maddox et al. |
| 6,338,263 | B1 | 1/2002 | Obata et al. |
| 6,488,993 | B2 | 12/2002 | Madigan |
| 7,108,469 | B2 | 9/2006 | Jenkins |
| 8,106,369 | B2 | 1/2012 | Drenter |
| 2002/0043311 | A1 | 4/2002 | Selepack et al. |
| 2012/0237694 | A1 | 9/2012 | Lorentzen et al. |
| 2013/0098928 | A1 | 4/2013 | Selepack et al. |
| 2013/0186905 | A1 | 7/2013 | Lorentzen et al. |

FOREIGN PATENT DOCUMENTS

| | | | |
|---|---|---|---|
| GB | 2027743 | A | 2/1980 |

OTHER PUBLICATIONS

International Search Report and Written Opinion for International (PCT) Patent Application No. PCT/US2013/020523 mailed Mar. 1, 2013, 8 pages.

International Search Report and Written Opinion for International (PCT) Patent Application No. PCT/US2012/055747 mailed Dec. 6, 2012, 7 pages.

Official Action for U.S. Appl. No. 13/621,516 mailed Apr. 12, 2013, 7 pages.

Official Action for U.S. Appl. No. 13/621,516 mailed Sep. 16, 2013, 10 pages.

Background of the Invention for the above captioned application (previously provided).

International Search Report and Written Opinion for International (PCT) Patent Application No. PCT/US2013/048507 mailed Dec. 6, 2013, 13 pages.

Prior Art Search for International (PCT) Patent Application No. PCT/US2012/55747 conducted Nov. 20, 2012, 6 pages.

International Preliminary Report on Patentablilty and Written Opinion for PCT/US2013/048507 dated Jul. 16, 2015, 12 pages.

Waite, "Aluminum firm makes new single-alloy can," American Metal Market Daily, Jun. 13, 2012, vol. 119, No. 24-3, 2 pages.

Extended European Search Report for EP 13870193, dated Sep. 2, 2016.

*Primary Examiner* — Jesse Roe

(74) *Attorney, Agent, or Firm* — Marsh Fischmann & Breyfogle LLP

(57) ABSTRACT

An aluminum alloy and recycle method are provided in which the recycled used beverage containers form an alloy composition useful with relatively minor or no compositional adjustments for body, end and tab stock, apart from magnesium levels.

22 Claims, 5 Drawing Sheets

USED BEVERAGE CONTAINER ALUMINUM COMPOSITION AND METHOD

CROSS REFERENCE TO RELATED APPLICATION

The present application claims the benefits of U.S. Provisional Application Ser. Nos. 61/833,276, filed Jun. 10, 2013, and 61/835,997, filed Jun. 17, 2013, each of which is incorporated herein by this reference in its entirety.

FIELD

The disclosure relates generally to containers and particularly to the composition and manufacture of aluminum alloy containers.

BACKGROUND

Recycling of metals and metal alloys is becoming increasingly important to maintain global environmental quality. Aluminum cans and other containers, for example, are recycled at higher levels than a decade ago. Currently, over 50% of all aluminum cans (also referred to as "Used Beverage Containers" or "UBC's") in the United States are recycled.

Current alloy chemistries in aluminum cans, however, create a metallurgical limit on the relative percentage of aluminum feedstock that can be derived from UBC's. Two common alloys for aluminum cans, by way of illustration, are AA 3004 (which is used for body stock) and 5182 (which is used for end and tab stock). AA 3004 commonly includes 0.8 to 1.3 wt. % magnesium and 0.9 to 1.5 wt. % manganese, while AA 5182 commonly includes from 4.0 to 5.0 wt. % magnesium and from 0.20 to 0.50 wt. % and more commonly no more than 0.35 wt. % manganese. AA 3104, another useful alloy for body stock, commonly includes 0.8 to 1.3 wt. % magnesium and 0.8 to 1.4 wt. % manganese. Assuming that body stock constitutes about 72 wt. % of the UBC while end and tab stock constitute about 28% of the UBC, a melt formed from a UBC currently contains about 1.71 wt. % magnesium and about 0.75 wt. % manganese. To form body stock from the UBC, the magnesium level needs to be reduced to about 1 wt. %. This reduction is effected using prime aluminum feedstock, thereby placing a practical limit of about 55 to 60 wt. % on the amount of aluminum feedstock that can be derived from UBCs.

A higher percentage of magnesium in the feedstock can cause problems in can manufacture. While the magnesium level in a UBC melt, which typically varies between 1.3 to 1.6 wt. %, is below the magnesium level in the AA 5182 alloy, which is specified as being between 4 and 5 wt. %, it is above the magnesium level in the AA 3004 and AA 3104 alloys, which is specified as being between 0.8 to 1.3 wt. %. Magnesium is a much more effective hot or cold work hardener compared to manganese. Higher magnesium levels in body stock can increase tear offs in the body maker and lead to problems in fabricating the neck and flange. By contrast, higher manganese levels than those specified for AA 5182 alloy (which varies between 0.20 to 0.50 wt. %) can be tolerated in the manufacture of ends from end stock.

There is a need for a container alloy composition and method of manufacture that can provide higher levels of UBC recycle.

SUMMARY

These and other needs are addressed by the various aspects, embodiments, and configurations of the present disclosure. The present disclosure is directed to an aluminum alloy composition that can be recycled and used for both body, end, and optionally tab stock.

A container can include a body and an end, the end comprising a connector to a tab for opening the container, wherein the body and end, and optionally the tab, each comprise an aluminum alloy and the aluminum alloys in the body and end (and the aluminum alloys in the body and tab) have an absolute value of a difference in manganese content commonly of no more than about 0.3 wt. %, more commonly less than 0.3 wt. %, more commonly of no more than about 0.25 wt. %, more commonly of no more than about 0.2 wt. %, more commonly of no more than about 0.15 wt. %, and even more commonly of no more than about 0.1 wt. %.

The container can include a body and an end, the end comprising a connector to a tab for opening the container, wherein the body and end, and optionally the tab, each comprises an aluminum alloy commonly having from about 0.2 to about 0.9 wt. % manganese, more commonly having from about 0.4 to about 0.9 wt. % manganese, more commonly having from about 0.4 to about 0.8 wt. % manganese, and even more commonly from about 0.45 to about 0.85 wt. % manganese.

The container can include a body and an end, the end comprising a connector to a tab for opening the container, wherein the body and end, and optionally the tab, each comprise an aluminum alloy. The manganese content of each of the aluminum alloys of the body and end (and the body and tab) each commonly differs by no more than about 35%, more commonly by no more than about 30%, more commonly by no more than about 25%, more commonly by no more than about 20%, more commonly by no more than about 15%, more commonly by no more than about 10%, more commonly by no more than about 7.5%, more commonly by no more than about 5%, more commonly by no more than about 2.5%, and even more commonly by no more than about 0.5%.

Aluminum alloy body stock for manufacture of a container can include commonly less than 0.8 wt. %, more commonly no more than about 0.75 wt. %, and even more commonly no more than about 0.7 wt. % manganese. The body stock can further include commonly from about 1 to about 2 wt. % magnesium and more commonly from about 1.1 to about 2 wt. % magnesium; commonly from about 0.2 to about 0.5 wt. % silicon; commonly from about 0.3 to about 0.6 wt. % iron; commonly from about 0.2 to about 0.5 wt. % copper; and commonly no more than about 5 wt. % impurities, with the balance being aluminum.

Aluminum alloy end and/or tab stock for manufacture of a container can include commonly more than 0.5 wt. %, more commonly at least about 0.55 wt. %, and even more commonly at least about 0.6 wt. % manganese. The end and/or tab stock can further include commonly from about 3.25 to about 5.5 wt. % magnesium and more commonly from about 4 to about 5.5 wt. % magnesium; commonly from about 0.2 to about 0.5 wt. % silicon; commonly from about 0.3 to about 0.6 wt. % iron; commonly from about 0.2 to about 0.5 wt. % copper; and commonly no more than about 5 wt. % impurities, with the balance being aluminum.

The method can include the steps of:

(a) casting a molten feedstock from used beverage containers to form a cast sheet, the used beverage containers having a body and an end, the end comprising a connector to a tab for opening the container, wherein the body and end, and optionally the tab, each comprise an aluminum alloy, wherein the aluminum alloys in the body and end (and the aluminum alloys in the body and tab) have an absolute value of a difference in manganese content commonly of no more than about 0.3 wt. %, more commonly less than 0.3 wt. %, more commonly of no more than about 0.25 wt. %, more commonly of no more than about 0.2 wt. %, more commonly of no more than about 0.15 wt. %, and even more commonly of no more than about 0.1 wt. %; and (b) forming the cast sheet into at least one of body and end stock, and optionally tab stock.

A method can include the steps of:

(a) casting a molten feedstock formed from used beverage containers to form a cast sheet, the used beverage containers having a body and an end, the end comprising a connector to a tab for opening the container, wherein the aluminum alloys in the body and end, and optionally the tab, each comprise commonly having from about 0.2 to about 0.9 wt. % manganese, more commonly having from about 0.4 to about 0.9 wt. % manganese, more commonly having from about 0.4 to about 0.8 wt. % manganese, and even more commonly from about 0.45 to about 0.85 wt. % manganese; and (b) forming the cast sheet into at least one of body and end stock, and optionally tab stock.

The method can include the steps of:

(a) casting a molten feedstock from used beverage containers to form a cast sheet, the used beverage containers having a body and an end, the end comprising a connector to a tab for opening the container, wherein the body and end, and optionally tab, each comprise an aluminum alloy, wherein the body and end, and optionally tab, each comprise an aluminum alloy, wherein the manganese contents of the aluminum alloys of the body and end, and optionally the body and tab, differ commonly by no more than about 35%, more commonly by no more than about 30%, more commonly by no more than about 25%, more commonly by no more than about 20%, more commonly by no more than about 15%, more commonly by no more than about 10%, more commonly by no more than about 7.5%, more commonly by no more than about 5%, more commonly by no more than about 2.5%, and even more commonly by no more than about 0.5%; and (b) forming the cast sheet into at least one of body and end stock.

The body, end, and tab stock can include any of the manganese amounts set forth above, wherein the aluminum alloy in the body comprises commonly from about 1 to about 2 wt. % magnesium, more commonly from about 1.1 to about 1.8 wt. % magnesium, and more commonly from about 1.4 to about 1.8 wt. % magnesium and wherein the aluminum alloy in the end, and optionally the tab, comprise commonly from about 3.25 to about 5.5 wt. % magnesium, from about 4 to about 5.5 wt. % magnesium, more commonly from about 4.25 to about 5 wt. % magnesium, and even more typically from about 4.30 to about 4.80 wt. % magnesium.

The aluminum alloys in the body and end, and optionally the tab, can be derived from a common melt of Used Beverage Containers. Accordingly, the body and end can each have the substantially same or the same level of one or more of silicon, iron, and copper. Stated another way, the body, end, and tab stock can include any of the manganese amounts set forth above, wherein the aluminum alloys of the body, end, and optionally the tab can each comprise at least substantially same level of at least one of silicon, iron, and copper. The body, end, and tab stock include commonly from about 0.2 to about 0.5 wt. % silicon; commonly from about 0.3 to about 0.6 wt. % iron; commonly from about 0.2 to about 0.5 wt. % copper; and commonly no more than about 5 wt. % impurities, with the balance being aluminum.

The present disclosure can provide a number of advantages depending on the particular configuration. The disclosure sets forth a universal alloy chemistry that can be recycled not only for end and tab stock but also for body stock. This can be done by holding manganese and one or more of iron, copper, silicon, and impurity levels substantially constant between the two types of stock while using differing magnesium levels. Commonly, the end and body stock are derived from a common melt of UBC's. Therefore, the body stock alloy chemistry can be effectively and substantially the same as a molten feedstock formed from Used Beverage Containers ("UBC's") while the end stock alloy chemistry can, with the exception of magnesium content, be effectively and substantially the same as the molten UBC feedstock. In this way, a predominantly UBC feedstock can be recycled for body and end stock, with only magnesium being added to the end stock to impart desired physical and/or mechanical properties. This is currently not possible with conventional body stock alloy chemistries. This ability can enable a much higher level of UBC recycle for a given container compared to conventional alloy chemistries, a lower consumption of more expensive prime aluminum feedstock, and lower cost aluminum alloy containers. The disclosure can make user behavior the limiter of a degree of UBC recycle and not a combination of user behavior and metallurgical requirements.

These and other advantages will be apparent from the disclosure of the aspects, embodiments, and configurations contained herein.

As used herein, "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together. When each one of A, B, and C in the above expressions refers to an element, such as X, Y, and Z, or class of elements, such as $X_1$-$X_n$, $Y_1$-$Y_m$, and $Z_1$-$Z_o$, the phrase is intended to refer to a single element selected from X, Y, and Z, a combination of elements selected from the same class (e.g., $X_1$ and $X_2$) as well as a combination of elements selected from two or more classes (e.g., $Y_1$ and $Z_o$).

The term "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

An "alloy" refers to an intimately mixed substance, substantially homogeneous mixture, and/or solid solution comprising two or more metals or of a metal or metals with a nonmetal. An aluminum alloy is typically a mixture of aluminum, as the predominant metal, with one or more other metals.

The phrase "continuous casting" refers to a casting process that produces a continuous strip as opposed to a process producing a rod or ingot.

The term "earing" is a mechanical property measured by the 45° earing or 45° rolling texture. Forty-five degrees refers to the position of the aluminum alloy sheet, which is 45° relative to the rolling direction. The value for the 45° earing is determined by measuring the height of the ears which stick up in a cup minus the height of the valleys between the ears. The difference is divided by the height of the valleys and multiplied by 100 to convert to a percentage.

The term "means" as used herein shall be given its broadest possible interpretation in accordance with 35 U.S.C., Section 112, Paragraph 6. Accordingly, a claim incorporating the term "means" shall cover all structures, materials, or acts set forth herein, and all of the equivalents thereof. Further, the structures, materials or acts and the equivalents thereof shall include all those described in the summary of the invention, brief description of the drawings, detailed description, abstract, and claims themselves.

The term "recrystallization" refers to a change in grain structure without a phase change as a result of heating the alloy above the alloy's recrystallization temperature.

The preceding is a simplified summary of the disclosure to provide an understanding of some aspects of the disclosure. This summary is neither an extensive nor exhaustive overview of the disclosure and its various aspects, embodiments, and configurations. It is intended neither to identify key or critical elements of the disclosure nor to delineate the scope of the disclosure but to present selected concepts of the disclosure in a simplified form as an introduction to the more detailed description presented below. As will be appreciated, other aspects, embodiments, and configurations of the disclosure are possible utilizing, alone or in combination, one or more of the features set forth above or described in detail below.

BRIEF DESCRIPTION OF THE DRAWINGS

The accompanying drawings are incorporated into and form a part of the specification to illustrate several examples of the present disclosure. These drawings, together with the description, explain the principles of the disclosure. The drawings simply illustrate preferred and alternative examples of how the disclosure can be made and used and are not to be construed as limiting the disclosure to only the illustrated and described examples. Further features and advantages will become apparent from the following, more detailed, description of the various aspects, embodiments, and configurations of the disclosure, as illustrated by the drawings referenced below.

DETAILED DESCRIPTION

Unless otherwise noted, all component or composition levels are in reference to the active portion of that component or composition and are exclusive of impurities, for example, residual solvents or by-products, which may be present in commercially available sources of such components or compositions.

All percentages and ratios are calculated by total composition weight, unless indicated otherwise.

It should be understood that every maximum numerical limitation given throughout this disclosure is deemed to include each and every lower numerical limitation as an alternative, as if such lower numerical limitations were expressly written herein. Every minimum numerical limitation given throughout this disclosure is deemed to include each and every higher numerical limitation as an alternative, as if such higher numerical limitations were expressly written herein. Every numerical range given throughout this disclosure is deemed to include each and every narrower numerical range that falls within such broader numerical range, as if such narrower numerical ranges were all expressly written herein. By way of example, the phrase from about 2 to about 4 includes the whole number and/or integer ranges from about 2 to about 3, from about 3 to about 4 and each possible range based on real (e.g., irrational and/or rational) numbers, such as from about 2.1 to about 4.9, from about 2.1 to about 3.4, and so on.

The present disclosure is directed, in various embodiments, to an aluminum alloy composition of a container that, when melted, can be used for both body and end stock. The component content levels of the various body and bottom formulations are interchangeable as are the component content levels of the various end stock formulations and tab stock formulations.

Figure 1A:
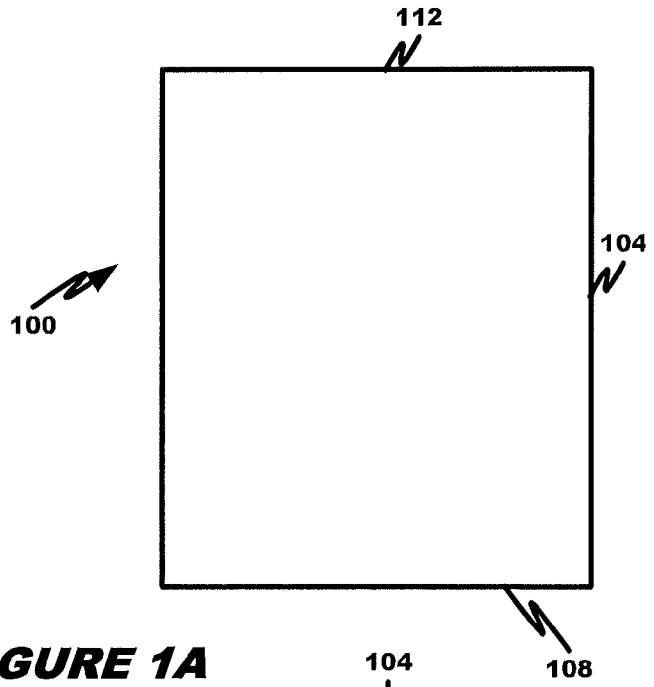
FIG. 1A is a side view of a container according to an embodiment.
Figure 1B:
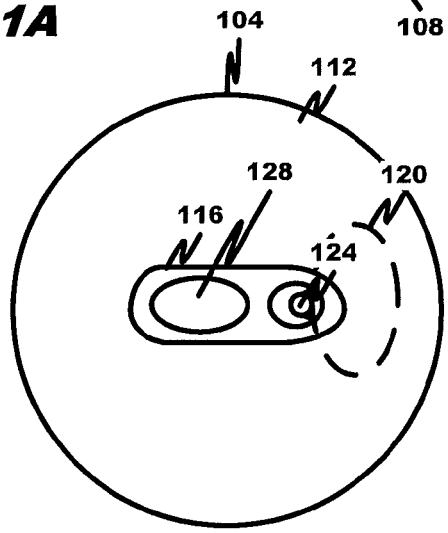
FIG. 1B is a top view of the container.
Figure 1C:
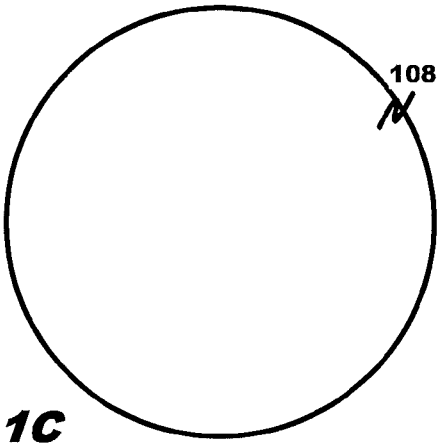
FIG. 1C is a bottom view of the container.

With reference to FIGS. 1A-C, the container 100 includes a cylindrical body 104 and bottom 108 formed from body stock and an end 112 and tab 116 formed from end stock. The end 112 includes a scored mouth flap 120. The tab 116 is fastened to the end 112 by a connector 124 (which is typically a bubble or dimple) about which the tab 116 rotates in response to a user's digit gripping the end of the tab 116 at the hole 128. The end of the tab 116, in response, applies pressure to the mouth flap 120, which breaks at the score lines from the end 112 and bends inwards into the container, thereby opening the contents of the container for user access. Typically, the end 112 and tab 116 constitute from about 25 to about 30 wt. % of the container 100, with the body 104 and bottom 108 constituting the remainder.

In one formulation, the body 104 and bottom 108 are formed from body stock having commonly from about 0.4 to about 1 wt %, more commonly from about 0.45 to about 0.8 wt. %, and even more commonly from about 0.6 to about 0.70 wt. % manganese and commonly from about 1.1 to about 2 wt %, more commonly from about 1.15 to about 1.8 wt. %, more commonly from about 1.2 to about 1.7 wt. %, more commonly from about 1.25 to about 1.65 wt. %, and even more commonly from about 1.55 to about 1.6 wt. % magnesium. The formulation can include other components, including commonly from about 0.2 to about 0.5 wt. %, more commonly from about 0.2 to about 0.4 wt. %, and even more commonly from about 0.2 to about 0.3 wt. % silicon, commonly from about 0.3 to about 0.6 wt. %, more commonly from about 0.33 to about 0.55 wt. % and even more commonly from about 0.4 to about 0.5 wt. % iron, commonly from about 0.2 to about 0.5 wt. %, more commonly from about 0.25 to about 0.45 wt. %, and even more commonly from about 0.3 to about 0.4 wt. % copper, and commonly no more than about 5 wt. % impurities, with the balance being aluminum.

In one formulation, the body 104 and bottom 108 are formed from body stock having commonly from about 0.75 to about 1 wt %, more commonly from about 0.80 to about 0.95 wt. %, and even more commonly from about 0.85 to about 0.90 wt. % manganese and commonly from about 1.1 to about 1.6 wt %, more commonly from about 1.15 to about 1.55 wt. %, more commonly from about 1.2 to about 1.60 wt. %, more commonly from about 1.25 to about 1.55 wt. %, and even more commonly from about 1.3 to about 1.5 wt. % magnesium. The formulation can include other components, including commonly from about 0.22 to about 0.29 wt. % and more commonly from about 0.25 to about 0.28 wt. % silicon, commonly from about 0.30 to about 0.50 wt. %, more commonly from about 0.33 to about 0.39 wt. % and more commonly from about 0.35 to about 0.38 wt. % iron, commonly from about 0.28 to about 0.33 wt. % and even more commonly from about 0.29 to about 0.32 wt. % copper, and commonly no more than about 5 wt. % impurities, with the balance being aluminum.

In one formulation, the body 104 and bottom 108 are formed from body stock having commonly from about 0.55 to about 0.90 wt %, more commonly from about 0.60 to about 0.85 wt. %, more commonly from about 0.65 to about 0.84 wt. %, more commonly from about 0.65 to about 0.80 wt. %, and even more commonly from about 0.65 to about 0.75 wt. % manganese and commonly from about 1.4 to about 1.8 wt %, more commonly from about 1.45 to about 1.75 wt. %, more commonly from more than 1.5 to about 1.70 wt. %, and even more commonly from about 1.5 to about 1.6 wt. % magnesium. The formulation can include other components, including commonly from about 0.22 to about 0.29 wt. % and more commonly from about 0.25 to about 0.28 wt. % silicon, commonly from about 0.30 to about 0.50 wt. %, more commonly from about 0.33 to about 0.39 wt. % and more commonly from about 0.35 to about 0.38 wt. % iron, commonly from about 0.28 to about 0.33 wt. % and even more commonly from about 0.29 to about 0.32 wt. % copper, and commonly no more than about 5 wt. % impurities, with the balance being aluminum.

In one formulation, the body 104 and bottom 108 are formed from body stock having commonly from about 0.25 to about 0.50 wt %, more commonly from about 0.30 to about 0.45 wt. %, and even more commonly from about 0.35 to about 0.40 wt. % manganese and commonly from about 1.5 to about 2.25 wt %, more commonly from about 1.60 to about 2.10 wt. %, more commonly from more than 1.70 to about 2.00 wt. %, and even more commonly from about 1.80 to about 2.00 wt. % magnesium. The formulation can include other components, including commonly from about 0.22 to about 0.29 wt. % and more commonly from about 0.25 to about 0.28 wt. % silicon, commonly from about 0.30 to about 0.50 wt. %, more commonly from about 0.33 to about 0.39 wt. % and more commonly from about 0.35 to about 0.38 wt. % iron, commonly from about 0.28 to about 0.33 wt. % and even more commonly from about 0.29 to about 0.32 wt. % copper, and commonly no more than about 5 wt. % impurities, with the balance being aluminum.

In one formulation, the body 104 and bottom 108, and body stock used to form them, include commonly less than 0.8 wt. %, more commonly no more than about 0.75 wt. %, and even more commonly no more than about 0.7 wt. % manganese. The other component levels (e.g., magnesium, silicon, iron, copper, and impurities) can be any of those set forth herein for body stock.

In one formulation, the body 104 and end 108, and optionally the tab, are formed from a molten alloy feedstock substantially or entirely derived from UBC's. The end and body and end and body stock, respectively, used to form each therefore have substantially the same or the same levels of manganese, iron, silicon, copper, and/or impurities. In this formulation, the body 104 and end 108 typically have a manganese content ranging from about 0.25 to about 0.90 wt. %, more typically from about 0.40 to about 0.80 wt. %, more typically from about 0.50 to about 0.75 wt. %, and even more typically from about 0.55 to about 0.65 wt. %; a copper content typically ranging from about 0.09 to about 0.35 wt. %, more typically from about 0.12 to about 0.32 wt. %, and even more typically from about 0.15 to about 0.30 wt. %, an iron content typically ranging from about 0.05 to about 0.50 wt. %, more typically from about 0.09 to about 0.39 wt. %, more typically from about 0.12 to about 0.38 wt. %, and even more typically from about 0.15 to about 0.37 wt. % iron; and a silicon content typically ranging from about 0.09 to about 0.30 wt. % silicon, more typically from about 0.12 to about 0.29 wt. %, and even more typically from about 0.15 to about 0.28 wt. %. The level of impurities end and body and end and body stock, respectively, used to form each typically is no more than about 5 wt. %, more typically no more than about 4.5 wt. %, and even more typically ranges from about 1.5 to about 4 wt. %.

To impart desired physical properties to the end stock, magnesium is typically added to the portion of the molten alloy feedstock used to form end stock. The magnesium content for the body and the body stock used to form it typically ranges from about 1.1 to about 2 wt. %, more typically from about 1.2 to about 1.9 wt. %, and even more typically from about 1.3 to about 1.8 wt. % while the magnesium content for the end and the end stock used to form it typically ranges from about 4 to about 5.5 wt. %, more typically from about 4 to about 5 wt. %, and even more typically from about 4 to about 4.9 wt. %.

In one formulation, apart from magnesium the end and tab and end and tab stock used to produce each, respectively, commonly have from about 0.4 to about 1 wt %, more commonly from about 0.45 to about 0.8 wt. %, and even more commonly from about 0.6 to about 0.70 wt. % manganese, commonly from about 0.2 to about 0.5 wt. %, more commonly from about 0.2 to about 0.4 wt. %, and even more commonly from about 0.2 to about 0.3 wt. % silicon, commonly from about 0.3 to about 0.6 wt. %, more commonly from about 0.33 to about 0.55 wt. % and even more commonly from about 0.4 to about 0.5 wt. % iron, commonly from about 0.2 to about 0.5 wt. %, more commonly from about 0.25 to about 0.45 wt. %, and even more commonly from about 0.3 to about 0.4 wt. % copper, and commonly no more than about 5 wt. % impurities, with the balance being aluminum.

According to another formulation, apart from magnesium the end 108 and body 104, and optionally the tab, and the end and body stock, and optionally the tab stock, respectively, used to form each typically have substantially the same component and impurity levels.

One way of expressing this compositional relationship is according to the following equations:

$$|C_{Body\ Stock}-C_{Tab\ Stock}|/Cn_{Body\ Stock}*100=X \quad (1)$$

$$|C_{Body\ Stock}-C_{Tab\ Stock}|/C_{Tab\ Stock}*100=Y \quad (2)$$

$$|C_{Body\ Stock}-C_{End\ Stock}|/C_{Body\ Stock}*100=Z \quad (3)$$

$$|C_{Tab\ Stock}-C_{End\ Stock}|/C_{End\ Stock}*100=W \quad (4)$$

$$|C_{Tab\ Stock}-C_{End\ Stock}|/C_{Tab\ Stock}*100=V \quad (5)$$

Where $C_{body\ stock}$ is the content of a selected component "C" (other than magnesium) of the body 104 or bottom, $C_{End\ Stock}$ is content of a selected component "C" (other than magnesium) of the end stock, and $C_{Tab\ Stock}$ is the content of a selected component "C" (other than magnesium) of the tab stock. By way of illustration, C is any of manganese, iron, silicon, copper and an impurity. Each of X, Y, Z, W, and V each are typically no more than about 35 wt. %, more typically no more than about 30 wt. %, more typically no more than about 25%, more typically no more than about 20%, more typically no more than about 15%, more typically no more than about 10%, more typically no more than about 7.5%, more typically no more than about 5%, more typically no more than about 2.5%, and more typically no more than about 0.5%. The above equations apply not only to the stock used to form each of the body, end, and tab but also to the components and compositions of the end 108 and body 104, and optionally the tab.

Another way of expressing this compositional relationship is according to the following equations:

$$|C_{Body\ Stock}-C_{Tab\ Stock}|=A \quad (1)$$

$$|C_{Body\ Stock}-C_{Tab\ Stock}|=B \quad (2)$$

When C is the manganese content (wt. %), each of A and B is typically less than 0.3 wt. %, more typically no more than about 0.25 wt. %, more typically no more than about 0.2 wt. %, more typically no more than about 0.15 wt. %, more typically no more than about 0.1 wt. %, and even more typically no more than about 0.05 wt. %. When C is any one of the content (wt. %) of iron, copper, iron, and/or impurity content And B are each typically no more than about 0.1 wt. %, more typically no more than about 0.075 wt. %, more typically no more than about 0.05 wt. %, and even more typically no more than about 0.025 wt. %.

These equations are generally applicable to any formulation discussed herein.

As will be appreciated, other aluminum alloys, particularly the AA 3000 and 5000 series alloys, may be used for the body stock.

An aluminum alloy product produced from this alloy commonly has an as-rolled (and before coating) and as coated (after coating) yield strength of at least about 11 ksi, more commonly ranging from about 20 to about 40 ksi, and even more commonly ranging from about 30 to about 40 ksi, an as-rolled (and before coating) and as coated (after coating) tensile strength of at least about 11 ksi, more commonly ranging from about 20 to about 44 ksi, and even more commonly ranging from about 30 to about 43 ksi, an elongation (180 degree directionality) of at least about 2%, even more commonly of at least about 2.5%, and even more commonly of at least about 3%, and/or an earing of less than about 1.8%. As will be appreciated, "earing" is typically measured by the 45 degree earing or 45 degree rolling texture. Forty-five degrees refers to the position of the aluminum alloy sheet which is 45 degrees relative to the rolling direction. The value for the 45 degree earing is determined by measuring the height of the ears which stick up in a cup, minus the height of valleys between the ears. The difference is divided by the height of the valleys and multiplied by 100 to convert to a percentage. A container body formed from the alloy product generally has a buckle strength ranging from about 65 to about 110 psi, more generally from about 70 to about 105 psi, and even more generally from about 85 to about 100 psi and a column strength of at least about 180 psi.

In one formulation, the end 112 and tab 116 are formed from end stock having commonly from about 0.25 to about 0.25 wt. %, more commonly from about 0.40 to about 0.80 wt. %, more commonly from about 0.40 to about 0.80 wt. %, more commonly from about 0.50 to about 0.65 wt. %, more commonly from about 0.55 to about 0.65 wt. %, more commonly from about 0.575 to about 0.65 wt. %, and even more commonly from about 0.60 to about 0.65 wt. % manganese and commonly from about 4 to about 5.5 wt %, more commonly from about 4.25 to about 5.25 wt. %, and even more commonly from about 4.5 to about 5 wt. % magnesium. The formulation can include other components, including commonly from about 0 to about 0.20 wt. % and more commonly from about 0.05 to about 0.20 wt. % silicon, commonly from about 0 to about 0.50 wt. %, more commonly from about 0 to about 0.29 wt. %, and more commonly from about 0.10 to about 0.28 wt. % iron, commonly from about 0.05 to about 0.25 wt. %, more commonly from about 0.09 to about 0.15 wt. % and even more commonly from about 0.095 to about 0.125 wt. % copper, and commonly no more than about 5 wt. % impurities, with the balance being aluminum.

In one formulation, the end 112 and tab 116 are formed from end stock having commonly from about 0.25 to about 0.55 wt %, more commonly from about 0.27 to about 0.45 wt. %, more commonly from about 0.29 to about 0.40 wt. %, and even more commonly from about 0.30 to about 0.35 wt. % manganese and commonly from about 4 to about 5.5 wt %, more commonly from about 4.25 to about 5.25 wt. %, and even more commonly from about 4.5 to about 5 wt. % magnesium. The formulation can include other components, including commonly from about 0 to about 0.20 wt. % and more commonly from about 0.05 to about 0.20 wt. % silicon, commonly from about 0 to about 0.50 wt. %, more commonly from about 0 to about 0.29 wt. % and more commonly from about 0.10 to about 0.28 wt. % iron, commonly from about 0.05 to about 0.25 wt. %, more commonly from about 0.09 to about 0.15 wt. % and even more commonly from about 0.095 to about 0.125 wt. % copper, and commonly no more than about 5 wt. % impurities, with the balance being aluminum.

In one formulation (which is particularly useful using non-EB coatings), the end 112 and tab 116 are formed from end stock having commonly from about 0.55 to about 0.90 wt %, more commonly from about 0.60 to about 0.85 wt. %, more commonly from about 0.65 to about 0.80 wt. %, and even more commonly from about 0.65 to about 0.75 wt. % manganese and commonly from about 4 to about 5 wt %, more commonly from about 4.25 to about 4.80 wt. %, and even more commonly from about 4.5 to about 4.80 wt. % magnesium. The formulation can include other components, including commonly from about 0 to about 0.20 wt. % and more commonly from about 0.05 to about 0.20 wt. % silicon, commonly from about 0 to about 0.50 wt. %, more commonly from about 0 to about 0.29 wt. % and more commonly from about 0.10 to about 0.28 wt. % iron, commonly from about 0.05 to about 0.25 wt. %, more commonly from about 0.09 to about 0.15 wt. % and even more commonly from about 0.095 to about 0.125 wt. % copper, and commonly no more than about 5 wt. % impurities, with the balance being aluminum.

In one formulation (which is particularly useful using EB coatings), the end 112 and tab 116 are formed from end stock having commonly from about 0.55 to about 0.90 wt %, more commonly from about 0.60 to about 0.85 wt. %, more commonly from about 0.65 to about 0.80 wt. %, and even more commonly from about 0.65 to about 0.75 wt. % manganese and commonly from about 3.25 to about 4.5 wt %, more commonly from about 3.4 to about 4.25 wt. %, more commonly from about 3.5 to about 4.00 wt %, and even more commonly from about 3.6 to less than 3.8 wt. % magnesium. The formulation can include other components, including commonly from about 0 to about 0.20 wt. % and more commonly from about 0.05 to about 0.20 wt. % silicon, commonly from about 0 to about 0.50 wt. %, more commonly from about 0 to about 0.29 wt. % and more commonly from about 0.10 to about 0.28 wt. % iron, commonly from about 0.05 to about 0.25 wt. %, more commonly from about 0.09 to about 0.15 wt. % and even more commonly from about 0.095 to about 0.125 wt. % copper, and commonly no more than about 5 wt. % impurities, with the balance being aluminum.

In one formulation, the end 112 and tab 116 and the stock used to form them include commonly more than 0.5 wt. %, more commonly at least about 0.55 wt. %, and even more commonly at least about 0.6 wt. % manganese. The other component levels (e.g., magnesium, silicon, iron, copper, and impurities) can be any of those set forth herein for end and/or tab stock, respectively.

Other end stock alloys may be employed. For making aluminum alloy products suitable for shaping into food container bodies or food or beverage container end panels, other AA 5000 series alloys include AA 5352, AA 5042, and AA 5017.

An aluminum alloy product produced from the above end stock alloy compositions commonly has an as-rolled (and before coating) and as coated (after coating) yield strength of at least about 15 ksi, more commonly ranging from about 25 to about 53 ksi, and even more commonly ranging from about 35 to about 53 ksi, an as-rolled (and before coating) and as coated (after coating) tensile strength of at least about 22 ksi, even more commonly ranging from about 30 to about 60 ksi, and even more commonly ranging from about 40 to about 60 ksi, and/or an elongation (45 degree directionality) of at least about 2%, even more commonly at least about 2.5%, and even more commonly of at least about 3%. The product commonly has a tab strength of at least about 2 kg, more commonly at least about 5 pounds, (i.e., about 2.3 kg), and even more commonly at least about 6 pounds (i.e., about 2.7 kg), and preferably no more than about 3.6 kg and most preferably no more than about 8 pounds (i.e., about 3.6 kg).

In one formulation, the manganese content of the body 104 and 108, end 112, and tab 116 is substantially the same, more commonly has a difference of no more than about 0.3 wt. %, more commonly of no more than about 0.25 wt. %, more commonly of no more than about 0.2 wt. %, more commonly of no more than about 0.15 wt. %. and more commonly of no more than about 0.1 wt. %, more commonly of no more than about 0.05 wt. %, and even more commonly of no more than about 0.01 wt. %.

Using the above formulations, the amount of the melt that can be formed from UBC's for use as body stock commonly is at least about 65 wt. %, more commonly at least about 70 wt. %, more commonly at least about 75 wt. %, more commonly at least about 80 wt. %, more commonly at least about 85 wt. %, more commonly at least about 90 wt. %, more commonly at least about 95 wt. %, and even more commonly at least about 99 wt. %. The amount of the melt that can be formed from UBC's for use as end stock commonly is at least about 65 wt. %, more commonly at least about 70 wt. %, more commonly at least about 75 wt. %, more commonly at least about 80 wt. %, more commonly at least about 85 wt. %, more commonly at least about 90 wt. %, more commonly at least about 95 wt. %, and even more commonly at least about 97.5 wt. %. In either case, the amount of the melt that is formed from prime (or new) aluminum feedstock is typically no more than about 40 wt. %, more typically no more than about 35 wt. %, more typically no more than about 30 wt. %, more typically no more than about 25 wt. %, more typically no more than about 20 wt. %, more typically no more than about 15 wt. %, more typically no more than about 10 wt. %, and even more typically no more than about 15 wt. %, more typically no more than about 5 wt. %.

To achieve these properties, the fabrication process must account for the different levels of manganese and magnesium compared to conventional alloy chemistry. For body stock, the level of manganese is generally lower than conventional body stock alloy chemistry; therefore, a higher magnesium level is used to maintain the desired physical and mechanical properties. For end and tab stock, the level of manganese is generally elevated compared to conventional end and tab stock; therefore a lower magnesium level is used to maintain the desired physical and mechanical properties. Higher magnesium levels must be taken into account in the body stock fabrication process to avoid an increase of tear offs in the body maker and control neck and flange issues. Higher manganese levels must be taken into account in the end and tab stock fabrication process to maintain satisfactory connector 124 formation and avoid tab fracture and tongue tears.

Figure 3:
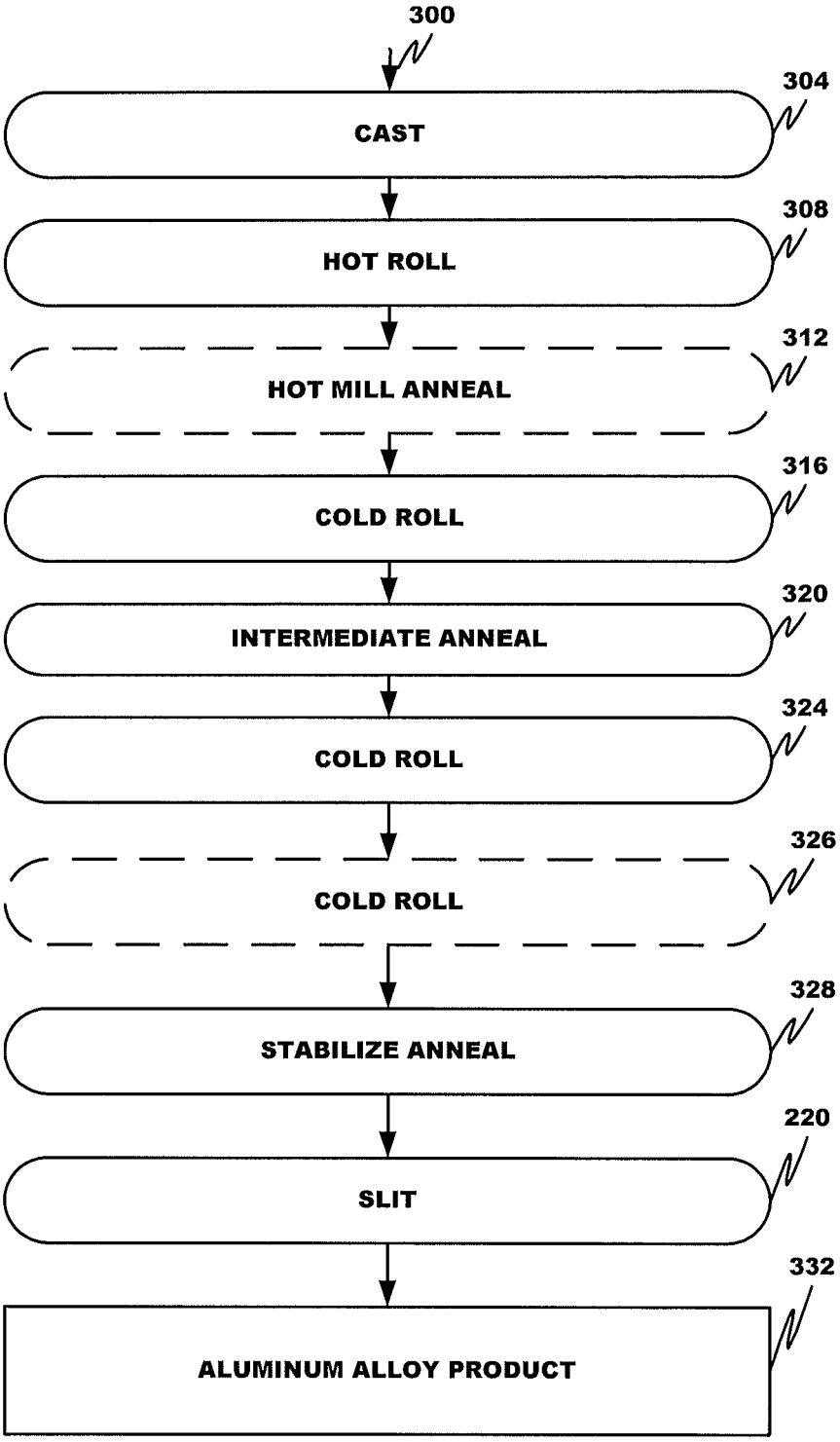
FIG. 3 is a flow chart according to an embodiment.
Figure 4:
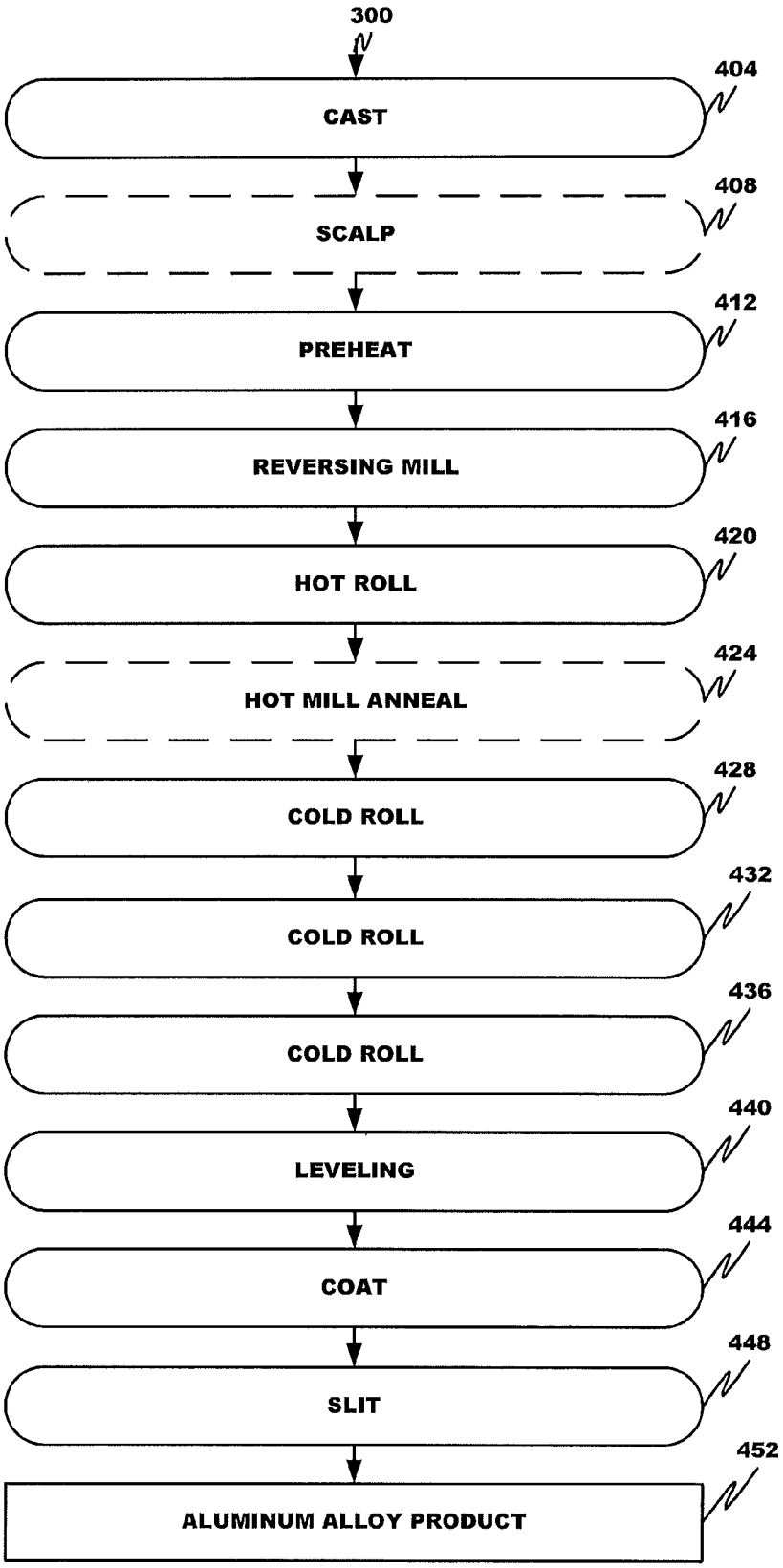
FIG. 4 is a flow chart according to an embodiment.
Figure 5:
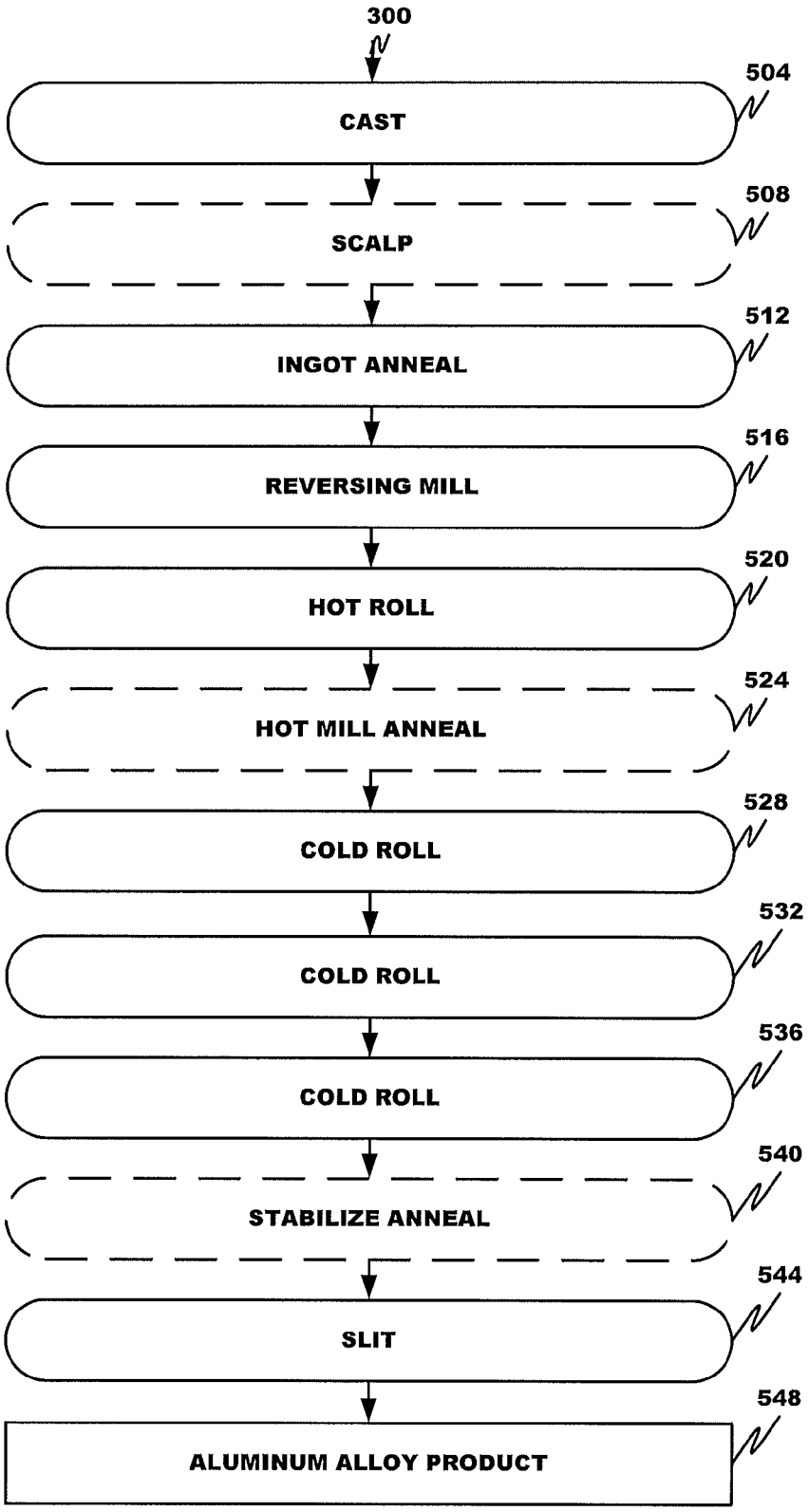
FIG. 5 is a flow chart according to an embodiment.

A fabrication process that is particularly useful for body stock is shown in FIG. 3.

A molten aluminum feedstock 300, formed primarily from UBC's, is continuously cast, such as by direct chill casting, belt casting, roll casting, or block casting, in step 304 to produce a cast sheet. In one configuration, the melt is then cast through a nozzle and discharged into the casting cavity. The nozzle can include a long, narrow tip to constrain the molten metal as it exits the nozzle. The nozzle tip has a preferred thickness ranging from about 10 to about 25 millimeters, more preferably from about 14 to about 24 millimeters, and most preferably from about 14 to about 19 millimeters and a width ranging from about 254 millimeters to about 2160 millimeters. The cast sheet typically has a gauge ranging from about 16 to about 19 mm and has an exit temperature ranging from about 800 to about 950 degrees Fahrenheit.

In step 308, the cast sheet is hot rolled, typically by a multi-stand hot mill, to form hot rolled sheet having a gauge ranging from about 0.065 to about 0.110 inches and an input temperature ranging from about 700 to about 850 degrees Fahrenheit and an exit temperature ranging from about 550 to about 650 degrees Fahrenheit.

The hot rolled sheet, in step 312 is optionally hot mill annealed, such as in a solenoidal heater, induction heater, transflux induction furnace, infrared heater, or gas-fired heater, typically at a temperature ranging from about 700 to about 1,000 degrees Fahrenheit and more typically ranging from about 700 to about 850 degrees Fahrenheit for a soak time ranging from about 3 to about 5 hours. The resulting hot mill annealed sheet is air-cooled to ambient temperature, which typically ranges from about 100 to about 120 degrees Fahrenheit.

The hot rolled or cooled, hot mill annealed sheet (as the case may be), in step 316, is cold rolled, typically by a multi-stand cold mill, to form a partially cold rolled sheet having a gauge commonly ranging from about 0.012 to about 0.045 inches and more commonly from about 0.015 to about 0.045 inches.

Depending on the reduction in gauge, a further cold rolling step 326 may be employed.

The partially cold rolled sheet, in step 320, is optionally intermediate annealed, such as in a solenoidal heater, induction heater, transflux induction furnace, infrared heater, or gas-fired heater, typically at a temperature ranging from about 650 to about 800 degrees Fahrenheit and more typically at a temperature ranging from about 700 to about 750 degrees Fahrenheit for a soak time ranging from about 3 to about 5 hours to form an intermediate annealed sheet. The intermediate annealed sheet is air cooled to ambient temperature.

The intermediate annealed sheet, in step 324, is subjected to further cold rolling to a finish gauge commonly ranging from about 0.008 to about 0.025 inches and even more commonly from about 0.0055 to about 0.025 inches.

The further cold rolled sheet is stabilize annealed in step 328, such as in a solenoidal heater, induction heater, transflux induction furnace, infrared heater, or gas-fired heater, at a temperature typically ranging from about 250 to about 550 degrees Fahrenheit, more typically ranging from about 275 to about 500 degrees Fahrenheit, and even more typically ranging from about 300 to about 450 degrees Fahrenheit for a soak time ranging from about 3 to about 5 hours and slit in step 220 to form an aluminum alloy product 332.

The aluminum alloy product 332 can be drawn and ironed to form a container body.

Figure 2:
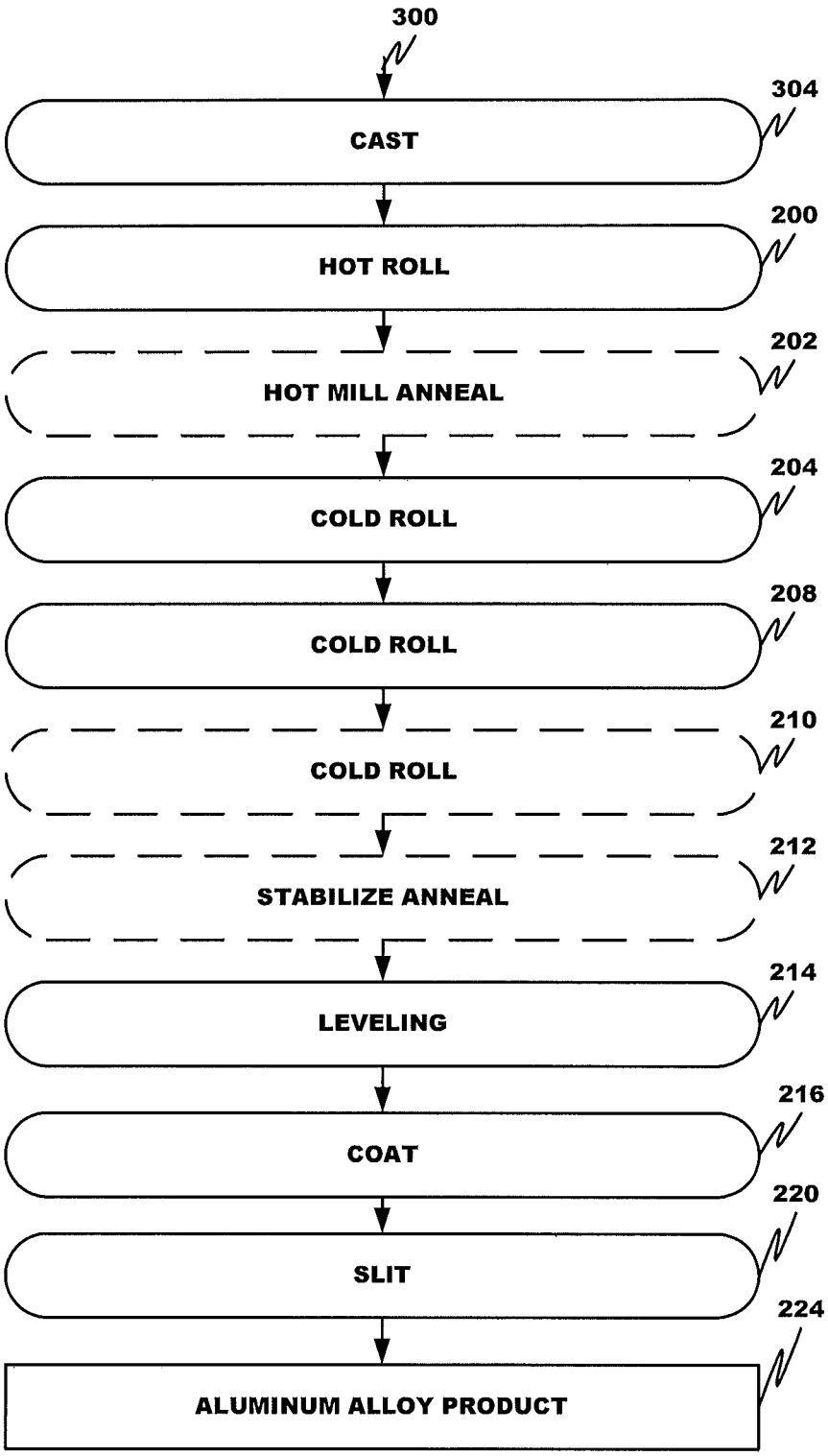
FIG. 2 is a flow chart according to an embodiment.

A fabrication process that is particularly useful for end and tab stock is shown in FIG. 2.

A molten aluminum feedstock 300, formed primarily from UBC's, is continuously cast, such as by direct chill casting, belt casting, roll casting, or block casting, in step 304 to produce a cast sheet. The cast sheet typically has a gauge ranging from about 16 to about 19 mm and has an exit temperature ranging from about 800 to about 950 degrees Fahrenheit.

In step 200, the cast sheet is hot rolled, typically by a multi-stand hot mill, to form hot rolled sheet having a gauge ranging from about 0.065 to about 0.110 inches and an exit temperature ranging from about 550 to about 650 degrees Fahrenheit.

The hot-rolled sheet is optionally hot mill annealed in step 202 at a temperature ranging from about 725 to about 900° F. to form a hot mill annealed sheet.

The hot rolled sheet or hot mill annealed sheet (as appropriate), in step 204, is cold rolled, typically by a multi-stand cold mill, to form a partially cold rolled sheet having a gauge ranging from about 0.065 to about 0.115 inches.

The partially cold rolled sheet, in step 208, is subjected to further cold rolling to a further cold rolled gauge commonly ranging from about 0.012 to about 0.045 inches and more commonly from about 0.015 to about 0.045 inches.

A further cold rolling step 210 can be used when greater gauge reductions are desired.

The further cold rolled sheet is optionally stabilize annealed in step 212, such as in a solenoidal heater, induction heater, transflux induction furnace, infrared heater, or gas-fired heater, at a temperature typically ranging from about 250 to about 500 degrees Fahrenheit, more typically ranging from about 275 to about 450 degrees Fahrenheit, and even more typically ranging from about 300 to about 400 degrees Fahrenheit for a soak time ranging from about 3 to about 5 hours.

The stabilized annealed sheet is leveled in step 214 and coated, in step 216, by a suitable process.

In one coating process, the stabilized annealed sheet is cleaned and chemically treated, optionally dried in an oven, optionally primed, coated, and thermally (oven) cured to form a coated sheet.

In another coating process, the stabilized annealed sheet is cleaned and chemically treated, coated with a suitable (e.g., food-grade) electron beam ("EB") and/or ultraviolet ("UV") curable coating composition, and EB or UV cured to form a coated sheet. Radiation curable polymer precursors are monomeric and/or oligomeric materials, such as acrylics, methacrylates, epoxies, polyesters, polyols, glycols, silicones, urethanes, vinyl ethers, and combinations thereof which have been modified to include functional groups and optionally photoinitiators that trigger polymerization, commonly cross-linking, upon application of UV or EB radiant energy. Radiation curable polymer precursors are monomeric and/or oligomeric materials such as acrylics, acrylates, acrylic acid, alkenes, allyl amines, amides, bisphenol A diglycidylether, butadiene monoxide, carboxylates, dienes, epoxies, ethylenes, ethyleneglycol diglycidylether, fluorinated alkenes, fumaric acid and esters thereof, glycols, glycidol, itaconic acid and esters thereof, maleic anhydride, methacrylates, methacrylonitriles, methacrylic acid, polyesters, polyols, propylenes, silicones, styrenes, styrene oxide, urethanes, vinyl ethers, vinyl halides, vinylidene halides, vinylcyclohexene oxide, conducting polymers such as dimethylallyl phosphonate, organometallic compounds including metal alkoxides (such as titanates, tin alkoxides, zirconates, and alkoxides of germanium and erbium), and combinations thereof, which have been modified to include functional groups and optionally photoinitiators that trigger polymerization upon the application of ultraviolet (UV) or electron beam (EB) radiant energy. Such polymer precursors include acrylated aliphatic oligomers, acrylated aromatic oligomers, acrylated epoxy monomers, acrylated epoxy oligomers, aliphatic epoxy acrylates, aliphatic urethane acrylates, aliphatic urethane methacrylates, allyl methacrylate, amine-modified oligoether acrylates, amine-modified polyether acrylates, aromatic acid acrylate, aromatic epoxy acrylates, aromatic urethane methacrylates, butylene glycol acrylate, silanes, silicones, stearyl acrylate, cycloaliphatic epoxides, cyclohexyl methacrylate, dialkylaminoalkyl methacrylates, ethylene glycol dimethacrylate, epoxy methacrylates, epoxy soy bean acrylates, fluoroalkyl(meth)acrylates, glycidyl methacrylate, hexanediol dimethacrylate, hydroxyethyl methacrylate, hydroxypropyl methacrylate, isodecyl acrylate, isoctyl acrylate, oligoether acrylates, polybutadiene diacrylate, polyester acrylate monomers, polyester acrylate oligomers, polyethylene glycol dimethacrylate, stearyl methacylate, triethylene glycol diacetate, trimethoxysilyl propyl methacrylate, and vinyl ethers. A typical curable coating composition includes from about 30 to about 60 wt. % reactive oligomer and from about 20 to about 40 wt. % reactive monomers.

Any suitable EB source may be employed, with scanning electron beam, continuous electron beam, and continuous compact electron beam EB sources being common. A typical EB source includes a high voltage supply that provides power to an electron gun assembly, positioned within an optional vacuum chamber having a foil window for passing electrons. Many coatings require a low oxygen environment during EB curing to cure or polymerize the coating. In such cases, nitrogen gas is pumped into the chamber to displace oxygen. Suitably positioned rollers positioned at the entrance and exit guide the movement of the sheet through the device. An exemplary EB source is disclosed in copending U.S. Ser. No. 12/401,269, filed Mar. 10, 2009, which is incorporated herein by this reference. Another EB source is manufactured by RPC Industries.

Compared to conventional coating lines with high temperature thermal curing, the lower temperature EB or UV coating process discussed above is commonly substantially free of recrystallization and sheet deformaties and can maintain mechanical properties of the stabilize annealed sheet substantially constant throughout the coating process. By way of illustration, a conventional coating line cures in a radiant oven at a temperature typically of at least about 350° F. and even more typically ranging from about 400° F. to 500° F. (peak metal temperature) (which can be above the recrystallization temperature of the aluminum alloy), compared to a temperature increase typically of no more than about 50° F., even more typically of no more than about 25° F., even more typically of no more than about 10° F., and even more typically of no more than about 5° F. in the EB or UV coating and curing steps.

The coated sheet, in step 220, is slit to form an aluminum alloy product 224.

The present disclosure is also applicable to discontinuous or ingot casting.

A molten aluminum feedstock 300, formed primarily from UBC's, is discontinuously cast, such as by ingot casting, in step 404 to produce a cast sheet.

The cast sheet, in step 408, is scalped.

The scalped sheet, in step 412, is preheated to heat soak the ingot. The preheating temperature typically ranges from about 900 to about 1,100° F.

In step 416, the preheated ingot is passed through a reversing mill to form a sheet.

The sheet, in step 420, is then hot rolled.

The hot rolled sheet, in optional step 424, is hot mill annealed at a temperature ranging from about 630 to about 900° F.

The hot rolled sheet or hot mill annealed sheet, as the case may be, is cold rolled in two to three passes in steps 428, 432, and 436.

The cold rolled sheet is leveled in step 440, coated in step 444, and slit in step 448 to form an aluminum alloy product 452 useful for tab and end stock.

To make body stock, a molten aluminum feedstock 300, formed primarily from UBC's, is discontinuously cast, such as by ingot casting, in step 504 to produce a cast sheet.

The cast sheet, in optional step 508, is scalped.

The scalped ingot, in step 512, is ingot annealed. The anneal temperature typically ranges from about 900 to about 1,100° F.

In step 516, the annealed ingot is passed through a reversing mill to form a sheet.

The sheet, in step 520, is hot rolled.

The hot rolled sheet, in optional step 424, is hot mill annealed at a temperature ranging from about 630 to about 900° F.

The hot rolled sheet or hot mill annealed sheet, as the case may be, is cold rolled in two to three passes in steps 528, 532, and 536.

The cold rolled sheet is optionally stabilized annealed in step 540 and slit in step 544 to form an aluminum alloy product 548.

A number of variations and modifications of the disclosure can be used. It would be possible to provide for some features of the disclosure without providing others.

The present disclosure, in various aspects, embodiments, and configurations, includes components, methods, processes, systems and/or apparatus substantially as depicted and described herein, including various aspects, embodiments, configurations, subcombinations, and subsets thereof. Those of skill in the art will understand how to make and use the various aspects, aspects, embodiments, and configurations, after understanding the present disclosure. The present disclosure, in various aspects, embodiments, and configurations, includes providing devices and processes in the absence of items not depicted and/or described herein or in various aspects, embodiments, and configurations hereof, including in the absence of such items as may have been used in previous devices or processes, e.g., for improving performance, achieving ease and\or reducing cost of implementation.

The foregoing discussion of the disclosure has been presented for purposes of illustration and description. The foregoing is not intended to limit the disclosure to the form or forms disclosed herein. In the foregoing Detailed Description for example, various features of the disclosure are grouped together in one or more, aspects, embodiments, and configurations for the purpose of streamlining the disclosure. The features of the aspects, embodiments, and configurations of the disclosure may be combined in alternate aspects, embodiments, and configurations other than those discussed above. This method of disclosure is not to be interpreted as reflecting an intention that the claimed disclosure requires more features than are expressly recited in each claim. Rather, as the following claims reflect, inventive aspects lie in less than all features of a single foregoing disclosed aspects, embodiments, and configurations. Thus, the following claims are hereby incorporated into this Detailed Description, with each claim standing on its own as a separate preferred embodiment of the disclosure.

Moreover, though the description of the disclosure has included description of one or more aspects, embodiments, or configurations and certain variations and modifications, other variations, combinations, and modifications are within the scope of the disclosure, e.g., as may be within the skill and knowledge of those in the art, after understanding the present disclosure. It is intended to obtain rights which include alternative aspects, embodiments, and configurations to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A method, comprising:

casting a molten feedstock from used beverage containers, the used beverage containers having a body and an end, the end comprising a connector to a tab for opening the container, wherein the body and end each comprise an aluminum alloy, the aluminum alloys of the body and end each comprise manganese and magnesium, wherein (i) the aluminum alloy of the body comprises from about 1 to about 2 wt. % magnesium, (ii) the aluminum alloy of the end comprises from about 4 to about 5.5 wt. % magnesium, and (iii) an absolute value of a difference between the manganese contents of the aluminum alloys is less than 0.3 wt. %;

forming the molten feedstock into a cast sheet of at least one of the aluminum alloy of the body and the aluminum alloy of the end.

2. The method of claim 1, wherein the absolute value of the difference in manganese content is no more than about 0.25 wt. %.

3. The method of claim 2, wherein the absolute value of the difference in manganese content is no more than about 0.1 wt. %.

4. The method of claim 1, wherein the aluminum alloy of the body and the aluminum alloy of the end each comprise silicon, and wherein the absolute difference between the silicon concentration in the aluminum alloy of the body and the silicon concentration in the aluminum alloy of the end is not greater than about 0.1 wt. %.

5. The method of claim 1, wherein the aluminum alloy of the body comprises from about 1.1 to about 2 wt. % magnesium.

6. The method of claim 1, wherein the aluminum alloy of the body comprises from about 1.2 to about 1.9 wt. % magnesium.

7. The method of claim 1, wherein the aluminum alloy of the body comprises from about 1.2 to about 1.9 wt. % magnesium.

8. The method of claim 1, wherein the aluminum alloy of the body comprises from about 0.25 to about 0.90 wt. % manganese.

9. The method of claim 1, wherein the aluminum alloy of the body comprises from about 0.40 to about 0.80 wt. % manganese.

10. The method of claim 1, wherein the aluminum alloy of the body comprises from about 0.50 to about 0.75 wt. % manganese.

11. The method of claim 1, wherein the aluminum alloy of the end comprises from about 4 to about 5 wt. % magnesium.

12. The method of claim 1, wherein the aluminum alloy of the end comprises from about 4 to about 4.9% magnesium.

13. The method of claim 1, wherein the aluminum alloy of the end comprises from about 0.25 to about 0.9 wt. % manganese.

14. The method of claim 1, wherein the aluminum alloy of the end comprises from about 0.4 to about 0.8 wt. % manganese.

15. The method of claim 1, wherein the aluminum alloy of the end comprises from about 0.50 to about 0.75 wt. % manganese.

16. The method of claim 1, wherein the aluminum alloy of the body and the aluminum alloy of the end each comprise copper, and wherein the absolute difference between the copper concentration in the aluminum alloy of the body and the copper concentration in the aluminum alloy of the end is not greater than about 0.1 wt. %.

17. The method of claim 1, wherein the aluminum alloy of the body and the aluminum alloy of the end each comprise iron, and wherein the absolute difference between the iron concentration in the aluminum alloy of the body and the iron concentration in the aluminum alloy of the end is not greater than about 0.1 wt. %.

18. The method of claim 1, wherein at least about 65 wt. % of the molten feedstock is derived from the used beverage containers.

19. The method of claim 1, wherein at least about 75 wt. % of the molten feedstock is derived from the used beverage containers.

20. The method of claim 1, wherein at least about 85 wt. % of the molten feedstock is derived from the used beverage containers.

21. A method, comprising:

casting a molten feedstock from at least about 65 wt. % used beverage containers, the used beverage containers having a body and an end, the end comprising a connector to a tab for opening the container, wherein the body and end each comprise an aluminum alloy, the aluminum alloys of the body and end each comprise manganese and magnesium, wherein, (i) the aluminum alloy of the body comprises from about 1.2 to about 2.0 wt. % magnesium and from about 0.25 to about 0.9 wt. % manganese, (ii) the aluminum alloy of the end comprises from about 4 to about 5 wt. % magnesium and from about 0.25 to about 0.9 wt. % manganese, and (iii) an absolute value of a difference between the manganese contents of the aluminum alloys is less than 0.3 wt. %; and forming the cast sheet into at least one of body and end stock.

22. A method, comprising:

casting a molten feedstock from at least about 75 wt. % used beverage containers, the used beverage containers having a body and an end, the end comprising a connector to a tab for opening the container, wherein the body and end each comprise an aluminum alloy, the aluminum alloys of the body and end each comprise manganese and magnesium, wherein, (i) the aluminum alloy of the body comprises from about 1.3 to about 1.8 wt. % magnesium and from about 0.4 to about 0.8 wt. % manganese, (ii) the aluminum alloy of the end comprises from about 4 to about 5 wt. % magnesium and from about 0.4 to about 0.8 wt. % manganese, and (iii) an absolute value of a difference between the manganese contents of the aluminum alloys is less than 0.1 wt. %; and forming the cast sheet into at least one of body and end stock.

* * * * *